US008087327B2

(12) United States Patent
Lorbach

(10) Patent No.: US 8,087,327 B2
(45) Date of Patent: Jan. 3, 2012

(54) TONGS

(75) Inventor: Wolfgang Lorbach, Haan (DE)

(73) Assignee: Knipex-Werk C. Gustav Putsch KG, Wuppertal (DE)

( * ) Notice: Subject to any disclaimer, the term of this patent is extended or adjusted under 35 U.S.C. 154(b) by 229 days.

(21) Appl. No.: 12/227,584

(22) PCT Filed: May 24, 2007

(86) PCT No.: PCT/EP2007/055059

§ 371 (c)(1),
(2), (4) Date: Feb. 10, 2009

(87) PCT Pub. No.: WO2007/135190

PCT Pub. Date: Nov. 29, 2007

(65) Prior Publication Data

US 2009/0165602 A1 Jul. 2, 2009

(30) Foreign Application Priority Data

May 24, 2006 (DE) ..... 10 2006 024 296

(51) Int. Cl.
*B25B 7/06* (2006.01)
*B25G 1/01* (2006.01)

(52) U.S. Cl. ..... 81/416; 81/489

(58) Field of Classification Search ..... 81/415, 81/416, 489

See application file for complete search history.

(56) References Cited

U.S. PATENT DOCUMENTS

| | | | | | |
|---|---|---|---|---|---|
| 888,606 | A | * | 5/1908 | Gemeny | 30/90.6 |
| 1,346,983 | A | | 7/1920 | Shaffer | |
| 2,305,156 | A | * | 12/1942 | Grubel | 403/114 |
| 3,017,692 | A | * | 1/1962 | Burnell | 29/229 |
| 3,911,766 | A | * | 10/1975 | Fridolph et al. | 76/101.1 |
| 3,952,749 | A | * | 4/1976 | Fridolph et al. | 606/208 |
| 4,099,315 | A | * | 7/1978 | Pudenz | 29/434 |
| 4,218,821 | A | | 8/1980 | Schneider | |
| 4,414,868 | A | * | 11/1983 | Puro | 81/416 |
| 4,478,532 | A | * | 10/1984 | Puro | 403/157 |

(Continued)

FOREIGN PATENT DOCUMENTS

DE 23 64 287 6/1975

(Continued)

OTHER PUBLICATIONS

International Search Report, PCT/EP2007/055059 (Feb. 13, 2008), pp. 1-5.

*Primary Examiner* — David B Thomas
(74) *Attorney, Agent, or Firm* — Collard & Roe, P.C.

(57) ABSTRACT

A pair of tongs with two tong limbs are connected rotatably to each other in a joint in which they are inserted and which has an axially fixed joint pin. The tong limbs are only rotatable with respect to each other. A working region and a handle region are formed in each case on one tong limb. A receiving tong limb is designed with an insertion slot which has a slot width in the region of the joint and through which the other inserted tong limb is inserted. The working regions of the tong limbs have a greater width, at least in part, than the slot width. The handle region of the inserted tong limb has a width and, if appropriate, a thickness which corresponds to the slot width. The handle covering has a reinforcing element.

15 Claims, 3 Drawing Sheets

U.S. PATENT DOCUMENTS

| | | | | |
|---|---|---|---|---|
| 4,823,792 | A * | 4/1989 | Dulebohn et al. | 606/151 |
| 5,740,586 | A * | 4/1998 | Gomas | 16/436 |
| D416,457 | S * | 11/1999 | Warner et al. | D8/52 |
| 5,996,450 | A | 12/1999 | St. John | |
| 6,014,917 | A * | 1/2000 | Bally et al. | 81/355 |
| 6,178,855 | B1 * | 1/2001 | Bally et al. | 81/355 |
| 6,386,070 | B1 * | 5/2002 | Hong | 81/20 |
| 6,405,619 | B1 * | 6/2002 | Lamond et al. | 81/177.1 |
| 6,513,198 | B2 * | 2/2003 | Lu | 16/431 |
| 6,739,217 | B2 * | 5/2004 | Hartranft et al. | 81/9.4 |
| 7,055,414 | B2 * | 6/2006 | Konen | 81/417 |
| 7,326,229 | B2 | 2/2008 | Dworschak | |
| 7,494,500 | B2 * | 2/2009 | Propp et al. | 606/205 |
| 2002/0033079 | A1 * | 3/2002 | Zurbuchen et al. | 81/427.5 |
| 2003/0181944 | A1 * | 9/2003 | Propp et al. | 606/205 |
| 2007/0056410 | A1 * | 3/2007 | Starr | 81/124.3 |

FOREIGN PATENT DOCUMENTS

| | | |
|---|---|---|
| DE | 28 26 421 | 1/1979 |
| DE | 200 06 450 | 9/2000 |
| WO | WO 03/013375 | 2/2003 |

* cited by examiner

TONGS

CROSS REFERENCE TO RELATED APPLICATIONS

This application is the National Stage of PCT/EP2007/055059 filed on May 24, 2007, which claims priority under 35 U.S.C. §119 of German Application No. 10 2006 024 296.3 filed on May 24, 2006. The international application under PCT article 21(2) was not published in English.

The invention relates to a pliers having two pliers limbs, which are rotatably connected to one another in a box-joint which has an axially-secured pivot pin, the pliers limbs being only pivotable relative to one another, and a working region and a gripping region being formed on each pliers limb, and a receiving pliers limb being provided with a box-joint slot which has a slot width in the joint region and through which the other inserted pliers limb is inserted, the working region of the pliers limbs furthermore having at least in part a greater width than corresponds to the slot width.

Pliers of this kind are known in a diversity of embodiments, in particular as side cutters, center cutters, end cutters or angle cutters, but also as for example long nose pliers with or without cutting edges. The latter, with cutters, are also known as pantograph pliers or radio pliers. The pliers here in question with a box-joint (or also a knuckle) are in particular required when the application of high forces is in question.

Conventionally, a pliers of this kind is made by the receiving pliers limb being plastically deformed in the region of the box-joint slot by being heated, and the other pliers limb being inserted. After this, a reverse plastics deformation takes place, so that the inserted pliers limb is secured because of the wider working region and the conventional wider gripping region in the receiving pliers limb, without this depending on the pivot pin. This manner of working is expensive and is also unsatisfactory in regard to choice of material. In particular, it is limited in respect of choice of suitable tempered steels. In addition, it does not always enable the desired precision in the joint region.

In order to provide an answer here, it has already been proposed, cf. U.S. Pat. No. 4,418,868, not to provide any slot on the receiving pliers limb, but rather a recess which is to be closed completely by a small plate, this suitably likewise being secured by means of the pivot pin. This in fact enables a pliers of this kind to be produced without the plastic deformation mentioned. On the other hand, the desired integral connection in the knuckle above and below the inserted pliers limb is no longer achieved. In addition, this known pliers requires an additional part, which in itself is a significant disadvantage for mass-produced products of this kind.

Proceeding from the above-described state of the art, the invention addresses the objective of providing a pliers which has a box-joint and can also be produced in an efficient manner with the least possible loss of advantages in respect of stability and the least possible imposition of limitations on the choice of materials.

This objective is met first and foremost by the subject matter of claim 1, where it is proposed that the gripping region of the inserted pliers limb has a width, and optionally a thickness, which corresponds to the slot width. The dimension in the height direction of the insertion slot is thereby specified by the width of the pliers limb, and the dimension in the longitudinal direction of the insertion slot is correspondingly determined by the thickness of the pliers limb, for example also in the longitudinal direction of the pliers limb having the insertion slot. It has been found according to the invention that while the working region of a pliers of this kind must have in all cases a greater width (and optionally also thickness) than corresponds to the slot width, this is not so for the gripping region. Here, a lack of width (and optionally also thickness) may, as desired, be suitably compensated. Heating up for assembling this pliers is no longer necessary, and neither is any plastic deformation. Nonetheless, the pliers limb having the insertion slot is still integrally formed, of the same material throughout, on both sides of the inserted pliers limb. Both the working region and the gripping region are integrally formed with the fork region forming the box-joint slot. The dimensions (width, but also thickness) of the receiving pliers limb, as also those of the inserted pliers limb, may be selected in the joint region as for a conventionally formed pliers, in that there is no difference in stability, since this is the most highly-loaded region. Materials may in fact be selected which are advantageous in respect of the demands. The inserted pliers limb is no longer secured in the receiving pliers limb by virtue of its geometry alone (disregarding the joint pin). The inserted pliers limb is held in the receiving pliers limb in the insertion direction only by means of the pivot pin. Guidance of the components with respect to one another transverse to the insertion direction is by contrast achieved directly as a result of the assembly of the pliers limbs.

The features explained below with reference to the further formulated claims may also be of importance in each case in their independent form.

The inserted pliers limb may have the same width over its entire length, this corresponding to the width of the slot. The slot width itself is also preferably the same over the entire length of the slot. By contrast, the width of the pliers limb may however, without difficulty, also be less outside the joint. A greater width is also possible throughout outside the joint, if an active region is defined between the joint and the greater width, the active region facilitating rotation after an initial insertion. In the active region, the thickness corresponds to the slot width in the joint region.

The thickness of the gripping region may also be selected to be smaller than corresponds to the slot width (the clear dimension of the slot perpendicular to its longitudinal direction, also therefore perpendicular to the longitudinal extent of the pliers limb).

It is further preferred that in each case the gripping region is surrounded by a gripping sleeve. For this, the gripping sleeve has as a rule a gripping opening receiving the gripping region of the pliers limb, the opening preferably being formed as a blind opening. The gripping sleeve may in particular be formed as an injection-molded plastics part. It is also preferred for the gripping sleeve to have a reinforcing element. The reinforcing element may be formed or arranged to extend longitudinally and to extend in the longitudinal direction of the gripping sleeve.

In particular, the reinforcing element may be a metal part, preferably a flat part. The reinforcing element may also be secured by over-molding in the gripping sleeve. For this, it is not necessary for the reinforcing element to be surrounded by plastics over its entire perimeter (if only a certain portion of its length). It is sufficient if it is surrounded by plastics only on one side or in addition by penetration into recesses or holes in the metal part, for it is only necessary to ensure that the metal part is held in the gripping sleeve to a sufficient extent for the gripping sleeve to be pushed onto the gripping region (optionally by heating up). For this, provision may be made for it to be secured in any case by the spatial conditions. This may be achieved in particular by a positively-acting surrounding, in the longitudinal direction, of the reinforcing element by the plastics material of the gripping sleeve.

It is also preferred for two reinforcing elements to be provided in the gripping sleeve, these being on opposite sides of the insertion opening of the gripping sleeve. These may each be exposed, facing one another, so that when applied to the pliers limb, they are directly in engagement against the (metallic) pliers limb.

Even if not necessary for the basic construction, it may however be preferred for both pliers limbs—outside the joint region and directed away from the working region—to be formed with similar gripping regions in respect of their geometric formation. It is not then necessary to equip the pliers limbs with different gripping sleeves. The receiving pliers limb may also be reduced to a thickness, outside the joint region and in the region covered over by the gripping sleeve, which corresponds to that of the inserted pliers limb in this region. Independently of a gripping sleeve, the inserted pliers limb may also be reinforced in the region in question only, or instead of this reception in the gripping sleeve, by strip parts, be they riveted on, latched on, or welded on. In this case, like gripping sleeves may then also be used for both pliers limbs (and then preferably without reinforcing elements).

The insertion slot is preferably provided, over its length, with the same width throughout, or a width that is in any case substantially the same.

This is as a rule achieved by a milling process, by means of a plane miller. The same width means here substantially that it may also taper somewhat, insofar as this is also conventional in principle, in order to achieve a clamping effect in the region of maximum opening.

A gripping sleeve for a pliers limb is also subject matter of the invention, the gripping sleeve having an insertion opening for receiving a gripping region of the pliers limb.

For a multiplicity of pliers, the pliers limbs are received in a special gripping sleeve. Understood in this respect are also gripping sleeves mounted by a dipping process. These have however no appreciable inherent stability. By contrast, gripping sleeves produced by the plastics injection-molding process are regarded as a rule as relatively stiff bodies, which can then be pushed onto the gripping region of a pliers limb. In principle, direct over-molding of a pliers limb is also possible.

It is pertinent that in the course of use, the gripping regions of the pliers limb do not become "embedded" in the plastics, or that there comes about in some other way widening or loosening of the gripping sleeves. For this, it is as a rule provided that the gripping regions of the pliers limbs are formed with dimensions that are sufficient for the surface pressure arising in the engagement region of a pliers limb against the inner surface of the insertion opening of the gripping sleeve to remain within limits that are acceptable for the plastics material.

On the other hand, this greatly limits the configuration of the—metallic—gripping limb of the pliers limb.

The invention also addresses the objective of providing a gripping sleeve for a pliers limb which offers a greater freedom of configuration in the geometric formation of a gripping limb of a pliers limb.

This objective is met first and foremost by the subject matter of claim 11 in which it is provided that the gripping sleeve has a reinforcing element. The reinforcing element is preferably not formed from the plastics material, although obviously in principle, it could also be formed from a plastics material, for example from a duroplastic hard plastics material. Rather, it is preferably formed from a metallic material.

By a reinforcing element being provided, improvements may be achieved in the critical regions of interaction of gripping sleeve and pliers limb. The pliers limb may in fact be formed with smaller geometric dimensions than match the material properties of the reinforcing element. In this way, greater surface pressure may for example be allowed.

The features described further below, for a gripping sleeve of this kind, which are contained in the subsidiary claims, may also be of importance in their independent formulation.

Thus it is preferred for the reinforcing element to extend in the longitudinal direction and to be disposed extending in the longitudinal direction of the gripping sleeves. It corresponds in its extent therefore to the gripping region of the pliers limb. It is preferably in any case provided in the width of the pliers limb, but may however also exceed this. The reinforcing element may in particular be formed as a flat part. It may also be secured in the gripping sleeve by over-molding. Also, reinforcing elements may be provided which are disposed in an opposed manner with respect to the insertion opening. Furthermore, features already described further above in connection with the pliers may also be applied to a gripping sleeve of this kind.

The invention is further described below with reference to the accompanying drawing, which however shows only exemplary embodiments. In the drawing.

Figure 1:
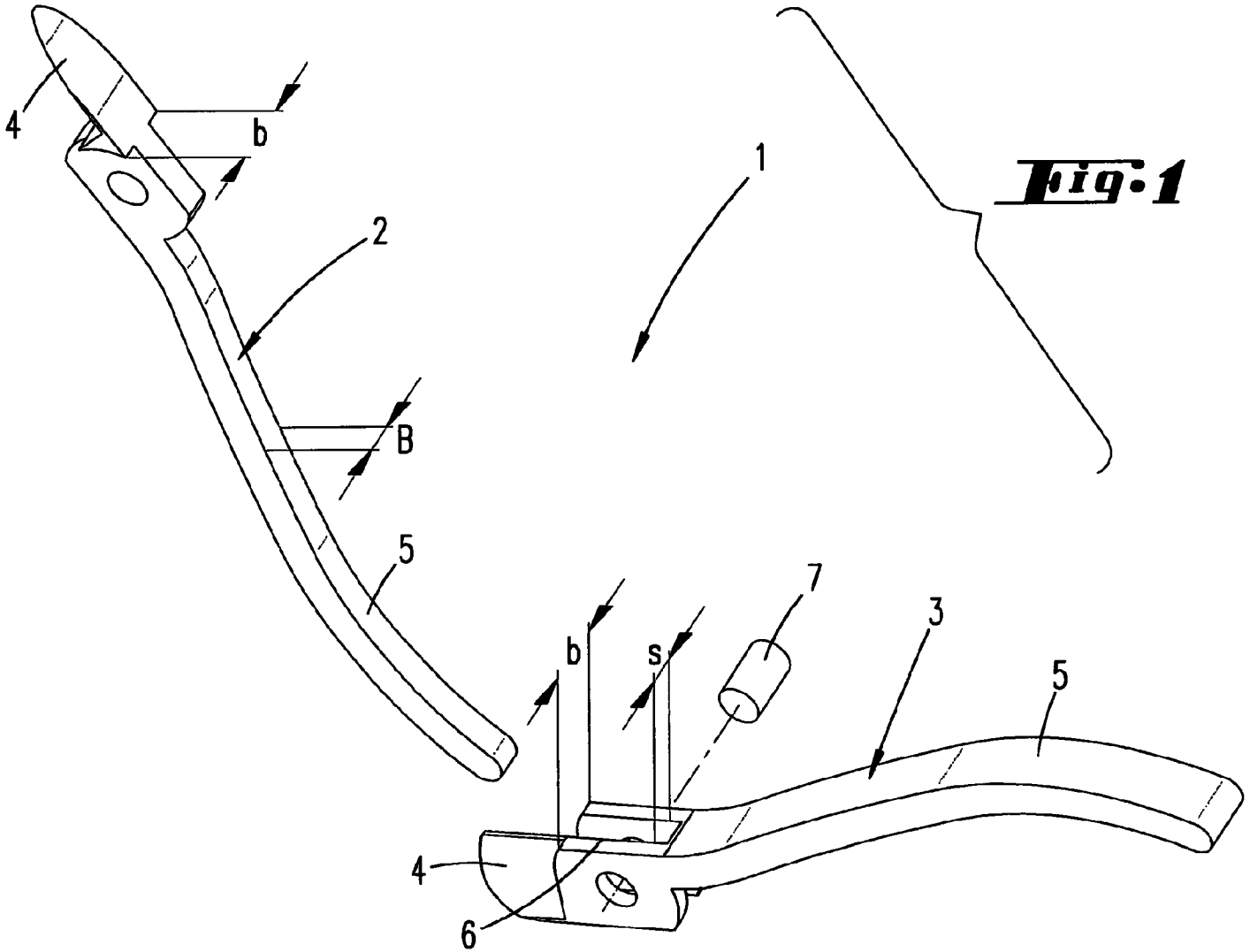
FIG. 1 shows, in perspective illustration, two pliers limbs intended to form a box-joined pliers.
Figure 2:
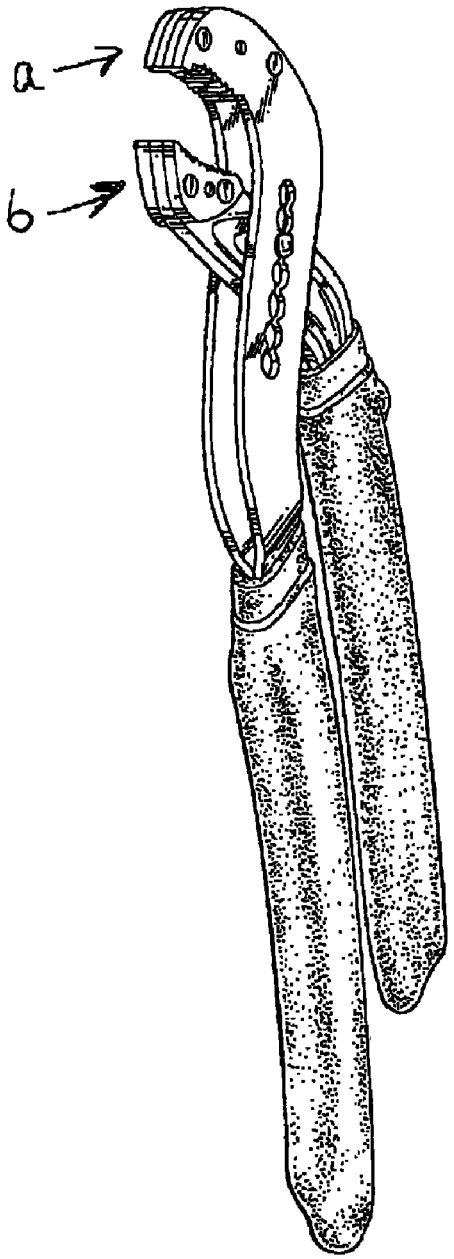
FIG. 2 shows a box-joined pliers, but without the gripping portions being covered.

Shown and described in first instance with reference to FIGS. 1 and 2 is a pliers 1 having two pliers limbs 2, 3. Each pliers limb 2, 3 has a working region 4 and a gripping region 5. In the case of the exemplary embodiment, the working region is formed as a side cutter.

The receiving pliers limb 3 also has a box-joint slot 6 through which the gripping region 5 of the inserted pliers limb 2 has been inserted in the assembled condition, cf. FIG. 2. The length L of the insertion slot 6 (cf. FIG. 2 for example) corresponds to approximately 3 to 10 times the width s of the slot, preferably 4 to 8 times, more preferably approximately 5 times the width of the slot.

The working regions 4 of each limb have, over part of their length, a greater width b than corresponds to the slot width s of the box-joint slot 6. In the tip region, the width is by contrast generally less than the width s of the slot, even running out into a point.

The gripping region 5 of the inserted pliers limb 5 has, by contrast, throughout over its entire length up to where it adjoins the working region 4, a width B which equates to the width s, or in any case does not exceed the width s. As is to be seen from FIG. 2, the pliers limb 2 can therefore be inserted into the pliers limb 3 without difficulty, without widening of the box-joint slot 6 being necessary, and, in the inserted condition, it can be connected to the receiving pliers limb 3, for example by a pivot pin formed as a pivot rivet 7. A screw may however for example also be used.

Figure 3:
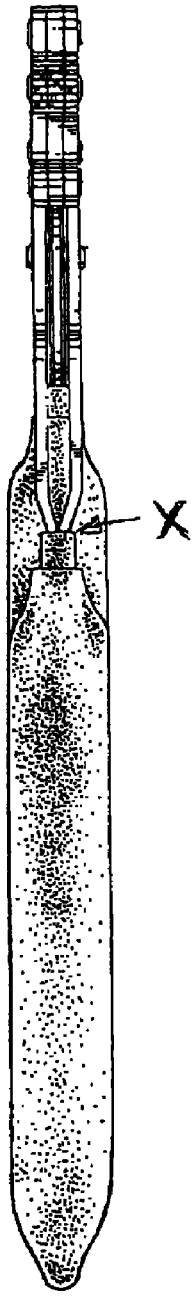
FIG. 3 shows the pliers according to FIG. 2 with gripping sleeves applied, in a top view.
Figure 4:
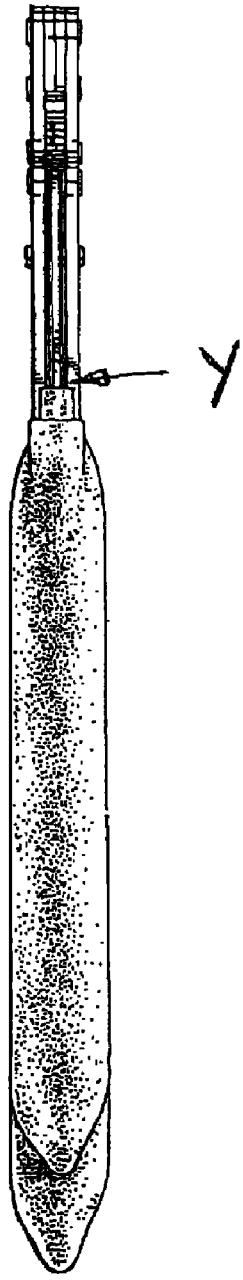
FIG. 4 shows the pliers according to FIG. 3 in a side view, looking onto the gripping limb of the box-joined pliers limb.

In FIGS. 3 and 4, a pliers 1 which has been completed with gripping sleeves 8, 9 is illustrated.

While the gripping regions of the pliers limbs 2, 3 have different thicknesses B according to the embodiment described here, the outer thickness A of the pliers limbs 2, 3 provided with the gripping sleeves 8, 9 is the same. The different thickness B of the gripping regions of the pliers limbs is compensated by the gripping sleeves 8, 9. This is specifically effected by the gripping sleeve 8, in the case of the exemplary embodiment, cf. FIG. 4, of the inserted pliers limb being formed with a smaller gripping opening 10 on account of its corresponding width h.

Figure 5:
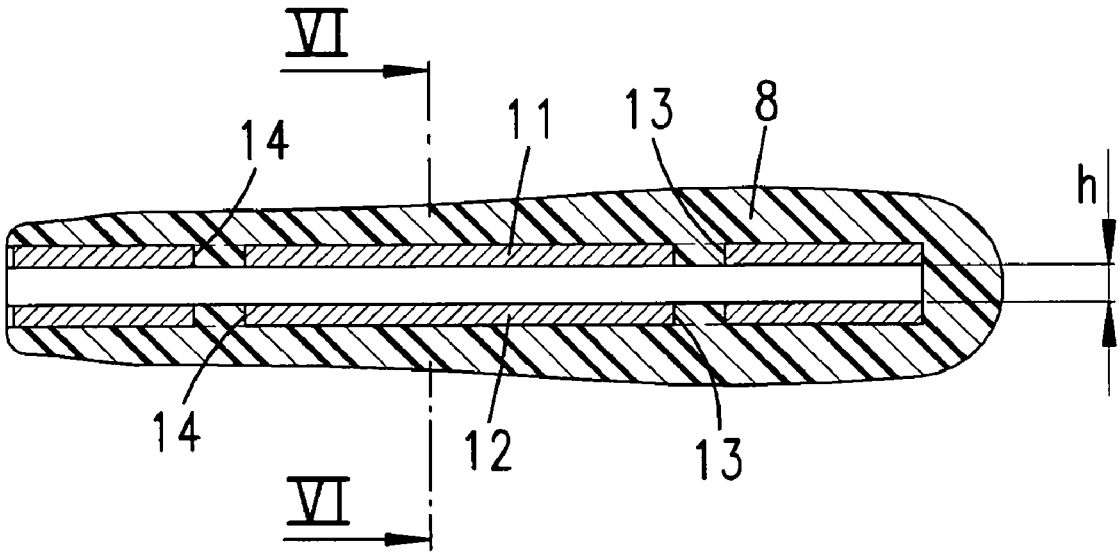
FIG. 5 shows a cross-section through a gripping sleeve.
Figure 6:
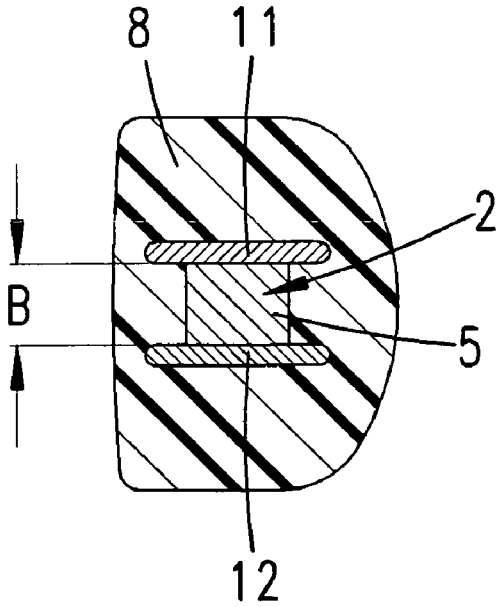
FIG. 6 shows a cross-section through the subject of FIG. 5, sectioned along the line VI-VI.
Figure 2:
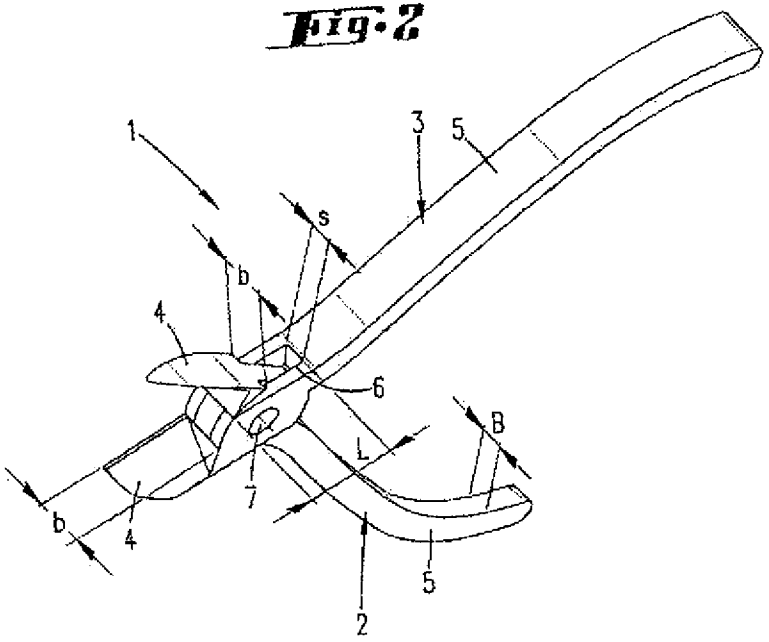
Figure 3:
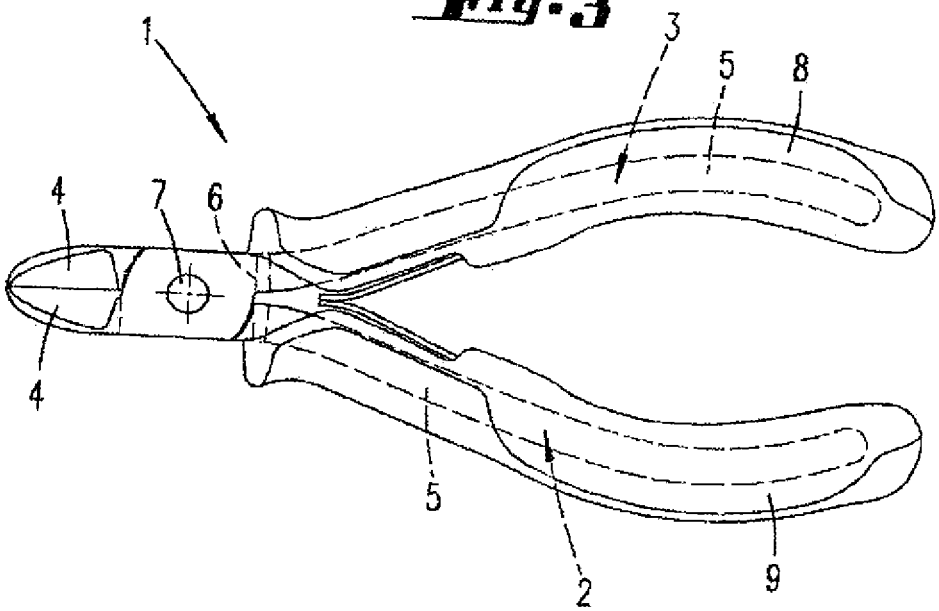
Figure 4:
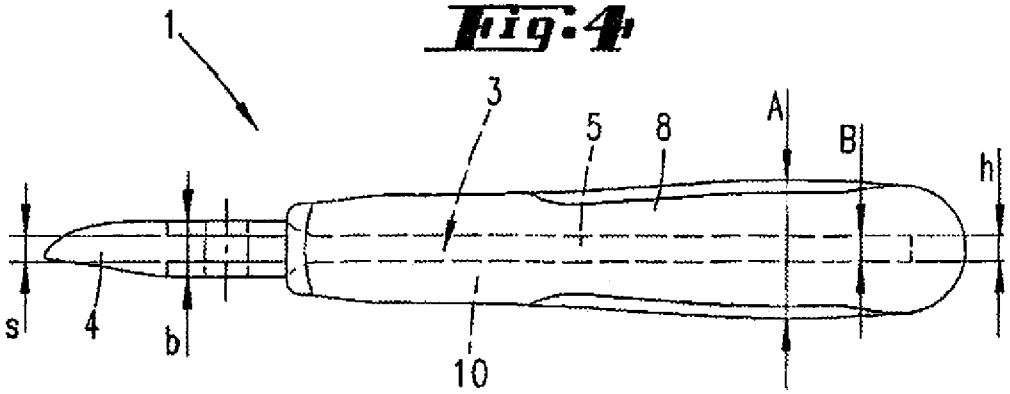

Since the dimension of the inserted pliers limb extending in the direction of the slot can equate throughout to the usual dimension, and the significant loading during use of a pliers is developed in this direction, it is in principle not necessary to effect further measures in respect of the gripping sleeve 8, other than merely to provide the insertion opening 10 with a smaller dimension, corresponding to the width B, than is the case for the gripping sleeve 9. In order however to counteract a possible lesser bendability in a direction of loading perpendicular to this, it is preferred to provide reinforcing elements 11, 12 in the gripping sleeve 8, cf. FIG. 5. For this, in the exemplary embodiment, flat metal parts are provided, which are arranged on opposite sides of the insertion opening 10 and have in each case two holes 13, 14. Plastics material of the gripping sleeve 8 which is produced by the plastics injection-molding process can penetrate into these holes, and accordingly secure the reinforcing elements, optionally in addition to a surrounding circumferential engagement in the transverse direction, cf. FIG. 6.

The reinforcing elements may be inserted directly into the injection mold and molding may accordingly take place around them.

If under certain circumstances it is desired to obviate different resistance to bending (compared with the unmodified gripping region of the receiving pliers limb) in the case of loading in the slot plane of the box-joint slot (the usual loading), it is recommended to provide also a bend-proof connection between the reinforcing element or elements and the gripping region of the inserted pliers limb, for example by mortising.

All features disclosed are (in themselves) pertinent to the invention. The disclosure content of the associated/accompanying priority documents (copy of the prior application) is also hereby incorporated in full in the disclosure of the application, also for the purpose of incorporating features of these documents in claims of the present application.

The invention claimed is:

1. A gripping sleeve produced by the plastics injection-molding process, for a pliers limb, the gripping sleeve having an insertion opening for receiving a gripping region of the pliers limb, wherein the gripping sleeve has a first reinforcing element, and wherein the first reinforcing element is a metal part.

2. The gripping sleeve according to claim 1, wherein the first reinforcing element ( ) extends longitudinally and is disposed so as to extend in the longitudinal direction of the gripping sleeves.

3. The gripping sleeve according to claim 1, wherein the first reinforcing element is secured by being over-molded in the gripping sleeve.

4. The gripping sleeve according to claim 1, further comprising a second reinforcing element, wherein the first reinforcing element is arranged on a first side and the second reinforcing element is arranged on a second side opposite to the first side with respect to the insertion opening.

5. Pliers having two pliers limbs which are rotatably connected to one another in a box-joint which has an axially-secured pivot pin, the pliers limbs being only pivotable relative to one another, and a working region and a gripping region being formed on each pliers limb, and a receiving pliers limb being provided with a box-joint slot which has a slot width in the joint region and through which the other inserted pliers limb is inserted, the working region of the pliers limbs furthermore having at least in part a greater width than corresponds to the slot width, wherein the receiving pliers limb is formed as a one-piece unit throughout on both sides of the inserted pliers limb, wherein the gripping region has a width-which corresponds to the slot width, so that the gripping region can be inserted into the pliers limb without widening of the box-joint slot being required, wherein the gripping region of the receiving pliers limb and the gripping region of the inserted pliers limb have different widths, and wherein the pliers limbs are provided with gripping sleeves causing each combination of a pliers limb, of the two pliers limbs, and a respective gripping sleeve, of the gripping sleeves, to have the same total width.

6. The pliers according to claim 5, wherein the thickness corresponding to the slot width is provided only over a partial region of the length of the gripping region.

7. The pliers according to claim 5, wherein the gripping sleeve is formed as an injection-molded plastics part.

8. The pliers according to claim 5, wherein the box-joint slot is formed to have the same width over its length.

9. The pliers according to claim 8, wherein the length of the box-joint slot corresponds to 3 to 10 times the slot width.

10. Pliers having two pliers limbs which are rotatably connected to one another in a box-joint which has an axially-secured pivot pin, the pliers limbs being only pivotable relative to one another, and a working region and a gripping region being formed on each pliers limb, and a receiving pliers limb being provided with a box-joint slot which has a slot width in the joint region and through which the other inserted pliers limb is inserted, the working region of the pliers limbs furthermore having at least in part a greater width than corresponds to the slot width, wherein the receiving pliers limb is formed as a one-piece unit throughout on both sides of the inserted pliers limb, wherein the gripping region has a width which corresponds to the slot width, so that the gripping region can be inserted into the pliers limb without widening of the box-joint slot being required, wherein the gripping region is in each case surrounded by a gripping sleeve which has a gripping opening—and wherein the gripping sleeve of the inserted pliers limb has a reinforcing element.

11. The pliers according to claim 10, wherein the reinforcing element extends longitudinally and is formed to extend in the longitudinal direction of the gripping sleeve.

12. The pliers according to claim 10, wherein the reinforcing element is secured by being over-molded in the gripping sleeve of the inserted pliers limb.

13. The pliers according to claim 10, wherein two reinforcing elements are provided in the gripping sleeve, the elements being on opposite sides with respect to the insertion opening in which the gripping region of the pliers limb is received.

14. Pliers having two pliers limbs which are rotatably connected to one another in a box-joint which has an axially-secured pivot pin, the pliers limbs being only pivotable relative to one another, and a working region and a gripping region being formed on each pliers limb, and a receiving pliers limb being provided with a box-joint slot which has a slot width in the joint region and through which the other inserted pliers limb is inserted, the working region of the pliers limbs furthermore having at least in part a greater width than corresponds to the slot width, wherein the receiving pliers limb is formed as an integral unit throughout on both sides of the inserted pliers limb, wherein the gripping region has a width which corresponds to the slot width, so that the gripping region can be inserted into the pliers limb without widening of the box-joint slot being required, and wherein for different widths of the two pliers limbs, the pliers limbs are provided with gripping sleeves causing each combination of a pliers limb, of the two pliers limbs, and a respective gripping sleeve, of the gripping sleeves, to have the same total width, wherein the gripping sleeve of the inserted pliers limb has a reinforcing element, and wherein the reinforcing element is a metal part.

15. Pliers having two pliers limbs which are rotatably connected to one another in a box-joint which has an axially-secured pivot pin, the pliers limbs being only pivotable relative to one another, and a working region and a gripping region being formed on each pliers limb, and a receiving pliers limb being provided with a box-joint slot which has a slot width in the joint region and through which the other inserted pliers limb is inserted, the working region of the pliers limbs furthermore having at least in part a greater width than corresponds to the slot width, wherein the receiving pliers limb is formed as an integral unit throughout on both sides of the inserted pliers limb, wherein the gripping region has a width which corresponds to the slot width, so that the gripping region can be inserted into the pliers limb without widening of the box-joint slot being required, wherein the gripping region is in each case surrounded by a gripping sleeve which has a gripping opening and wherein the gripping sleeve of the inserted pliers limb has a reinforcing element, and wherein the reinforcing element is a metal part.

* * * * *

UNITED STATES PATENT AND TRADEMARK OFFICE

CERTIFICATE OF CORRECTION

PATENT NO. : 8,087,327 B2
APPLICATION NO. : 12/227584
DATED : January 3, 2012
INVENTOR(S) : Lorbach It is certified that error appears in the above-identified patent and that said Letters Patent is hereby corrected as shown below:

The title page showing an illustrative figure should be deleted and substitute therefor the attached title page Delete drawing sheets 2-4 and substitute therefor the drawings sheets consisting of figures 2-4 as shown on the attached pages.

Signed and Sealed this
Twenty-eighth Day of February, 2012

David J. Kappos

David J. Kappos
*Director of the United States Patent and Trademark Office*

(12) United States Patent
Lorbach

(10) Patent No.: US 8,087,327 B2
(45) Date of Patent: Jan. 3, 2012

(54) TONGS

(75) Inventor: Wolfgang Lorbach, Haan (DE)

(73) Assignee: Knipex-Werk C. Gustav Putsch KG, Wuppertal (DE)

( * ) Notice: Subject to any disclaimer, the term of this patent is extended or adjusted under 35 U.S.C. 154(b) by 229 days.

(21) Appl. No.: 12/227,584

(22) PCT Filed: May 24, 2007

(86) PCT No.: PCT/EP2007/055059
§ 371 (c)(1),
(2), (4) Date: Feb. 10, 2009

(87) PCT Pub. No.: WO2007/135190
PCT Pub. Date: Nov. 29, 2007

(65) Prior Publication Data

US 2009/0165602 A1 Jul. 2, 2009

(30) Foreign Application Priority Data

May 24, 2006 (DE) ..... 10 2006 024 296

(51) Int. Cl.
*B25B 7/06* (2006.01)
*B25G 1/01* (2006.01)

(52) U.S. Cl. ..... 81/416; 81/489
(58) Field of Classification Search ..... 81/415, 81/416, 489
See application file for complete search history.

(56) References Cited

U.S. PATENT DOCUMENTS

| | | | | | |
|---|---|---|---|---|---|
| 888,606 | A | * | 5/1908 | Gemeny | 30/90.6 |
| 1,346,983 | A | | 7/1920 | Shaffer | |
| 2,305,156 | A | * | 12/1942 | Grubel | 403/114 |
| 3,017,692 | A | * | 1/1962 | Burnell | 29/229 |
| 3,911,766 | A | * | 10/1975 | Fridolph et al. | 76/101.1 |
| 3,952,749 | A | * | 4/1976 | Fridolph et al. | 606/208 |
| 4,099,315 | A | * | 7/1978 | Pudenz | 29/434 |
| 4,218,821 | A | | 8/1980 | Schneider | |
| 4,414,868 | A | * | 11/1983 | Puro | 81/416 |
| 4,478,532 | A | * | 10/1984 | Puro | 403/157 |

(Continued)

FOREIGN PATENT DOCUMENTS

DE 23 64 287 6/1975

(Continued)

OTHER PUBLICATIONS

International Search Report, PCT/EP2007/055059 (Feb. 13, 2008), pp. 1-5.

*Primary Examiner* David B Thomas
(74) *Attorney, Agent, or Firm* — Collard & Roe, P.C.

(57) ABSTRACT

A pair of tongs with two tong limbs are connected rotatably to each other in a joint in which they are inserted and which has an axially fixed joint pin. The tong limbs are only rotatable with respect to each other. A working region and a handle region are formed in each case on one tong limb. A receiving tong limb is designed with an insertion slot which has a slot width in the region of the joint and through which the other inserted tong limb is inserted. The working regions of the tong limbs have a greater width, at least in part, than the slot width. The handle region of the inserted tong limb has a width and, if appropriate, a thickness which corresponds to the slot width. The handle covering has a reinforcing element.

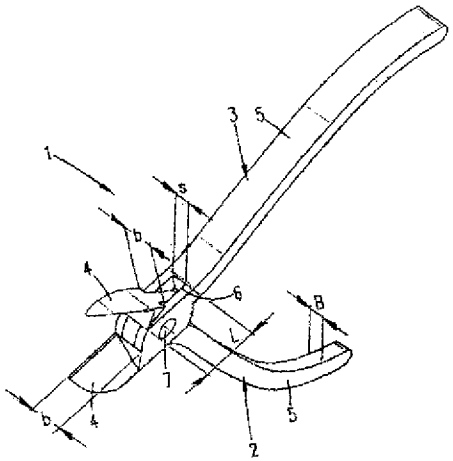

15 Claims, 3 Drawing Sheets